US005114396A

United States Patent [19]

Unger et al.

[11] Patent Number: 5,114,396

[45] Date of Patent: May 19, 1992

[54] METHOD OF WASHING BLOOD CELLS AND CONTAINER ASSEMBLY THEREOF

[75] Inventors: Peter Unger, Stockholm; Eric Westberg, Lidingö , both of Sweden

[73] Assignee: Omega Medicinteknik AB, Sweden

[21] Appl. No.: 722,351

[22] Filed: Jun. 18, 1991

Related U.S. Application Data

[63] Continuation of Ser. No. 469,524, Mar. 14, 1990, abandoned.

[30] Foreign Application Priority Data

Sep. 15, 1987 [SE] Sweden ..... 8703562-2

[51] Int. Cl.[5] ..... B04B 5/02; B04B 11/06

[52] U.S. Cl. ..... 494/37; 422/72; 494/27; 494/45

[58] Field of Search ..... 494/17, 37, 16, 18, 494/21, 45, 27, 23, 34; 422/72

[56] References Cited

U.S. PATENT DOCUMENTS

| | | | |
|---|---|---|---|
| 3,326,458 | 6/1967 | Meryman et al. . | |
| 3,679,128 | 7/1972 | Unger et al. . | |
| 3,737,096 | 6/1973 | Jones et al. | 494/12 X |
| 3,864,089 | 2/1975 | Tiffany et al. | 494/17 X |
| 3,885,735 | 5/1975 | Westbert | 494/42 |
| 4,244,513 | 1/1981 | Fayer et al. | 494/16 X |
| 4,767,397 | 8/1988 | Hohenberg et al. | 494/45 X |
| 4,846,780 | 7/1989 | Galloway et al. | 494/45 X |
| 5,032,288 | 7/1991 | Columbus et al. | 494/37 X |

FOREIGN PATENT DOCUMENTS

| | | |
|---|---|---|
| 87/06857 | 11/1987 | European Pat. Off. . |
| WO87/06844 | 11/1987 | World Int. Prop. O. . |

OTHER PUBLICATIONS

Transfusion, vol. 12, No. 4, pp. 237-244, Jul.-Aug. 1972 (A. H. Runck et al) "Continuous flow Centrifugation Washing of Red Blood Cells".

Transfusion, vol. 16, No. 6, Nov.-Dec. 1976, (T. J. Contreras et al) "A Comparison of Methods to Wash Liquid-Stored Red Blood Cells and Red Blood Cells Frozen with High or Low Concentrations of Glycerol", pp. 539-565.

*Primary Examiner*—Daniel M. Yasich

*Attorney, Agent, or Firm*—Hill, Van Santen, Steadman & Simpson

[57] ABSTRACT

Thawed glycerolized red blood cells are washed in a system (1) of closed collapsible containers of flexible material which are positioned concentrically in a centrifuge rotor. The blood cells are held in an annular primary container (2) into which wash liquid is centrifugally fed from a c entral container (3) and from which supernatant is expressed into a central waste container (4) while the primary container is being compressed as a result of centrifugal action on an elastic body (24) in the rotor. A container assembly (1) for use in carrying out the washing comprises an annular collapsible primary container (2), a collapsible circular closed wash liquid container (3), a collapsible circular, closed waste container (4), and valve controlled conduits for passing liquid from the wash liquid container into the primary container and from the primary container into the waste container. The wash liquid container (3) and the waste container (4) are positioned one on top of the other in the circular area surrounded by the primary container (2).

8 Claims, 4 Drawing Sheets

METHOD OF WASHING BLOOD CELLS AND CONTAINER ASSEMBLY THEREOF

This is a continuation of application Ser. No. 469,524, filed Mar. 14, 1990.

TECHNICAL FIELD

This invention relates to a method of discontinuous washing of blood cells and a container assembly for use in washing discrete quantities or batches of blood cells in a centrifuge.

BACKGROUND OF THE INVENTION

Washing of blood cells is required e.g. when frozen and glycerolized red blood cells are to be reconstituted for transfusion to a recipient. After thawing, the blood cells are liberated from glycerol and other undesired components by repeated washing steps using a wash solution. Blood cells which have been processed by techniques other than glycerolization and freezing so as to be capable of long-term storage likewise have to be washed free of additives before they can be transfused to a recipient.

U.S. Pat. No. 3,326,458, U.S. Pat. No. 3,679,128, U.S. Pat. No. 3,737,096 and U.S. Pat. No. 3,858,796 disclose examples of methods for batch washing of blood cells and of centrifuges and container assemblies for use in carrying out such washing methods.

More particularly, U.S. Pat. No. 3,326,458 discloses batch washing of glycerolized red blood cells in a system of closed collapsible containers of flexible material which are positioned concentrically in a centrifuge rotor. An annular processing or primary container holds the cells to be washed and communicates through collapsible conduits with other containers, including a circular, centrally positioned wash liquid container and an annular waste container which is positioned radially outwardly of the primary container. Pinch valves are provided to control the flow between the primary container, on the one hand, and the wash liquid container and the waste container, on the other hand.

When a batch of thawed glycerolized red blood cells held in the primary container is to be reconstituted, the centrifuge rotor is spun at appropriate speed until the red blood cells have sedimented in the radially outer portion of the primary container. While the rotor is spinning, the valve controlling the flow from the primary container into the waste container is opened to allow the glycerol supernatant to flow into the waste container. To this end, a predetermined volume of compressing liquid is centrifugally actuated to cause compression of the primary container so that an equal volume of supernatant is expressed from it.

Following closing of the just-mentioned valve, the valve controlling the flow from the wash liquid container into the primary container is opened to allow wash liquid to flow under action of the centrifugal field into the primary container, thereby expanding it and displacing the compressing liquid against action of the centrifugal field. The wash liquid mixes with the pack or concentrate of red blood cells and is then centrifugally separated from the cells to form a supernatant which is subsequently expressed into the waste container in the manner described above with reference to the glycerol supernatant.

The steps of admitting a predetermined volume of wash liquid into the primary container and subsequently expressing it into the waste container together with liberated contaminating substances are repeated until the red blood cells are clinically acceptable.

SUMMARY OF THE INVENTION

An object of the invention is to provide an improved method of batch washing of blood cells in a centrifuge using a system of closed collapsible concentric containers of flexible material and utilizing the centrifugal field to effect the transfer of wash liquid and supernatant between a primary container holding the cells, on the one hand, and wash liquid and waste containers, on the other hand.

Another object of the invention is to provide an improved container assembly for use in washing blood cells in a centrifuge.

In view of the foregoing and other objects, the invention provides a method and a container assembly as defined in the claims.

As will be explained in greater detail below, the wash liquid is transferred radially outwardly from the centrally positioned wash liquid container to the annular primary container and then, in the form of a supernatant, radially inwardly, against the direction of the centrifugal field, from the primary container to the waste container which is likewise positioned centrally, the transfer being effected in both directions with the aid of the centrifugal field.

To this end, an elastic body (a body of solid material which changes its shape and size under action of opposing forces but recovers its original shape when the forces are removed) is used to apply to the primary container a centrifugally produced force which tends to compress the primary container and which prevails over the head of pressure of the liquid in the waste container when radially inward transfer is to be effected but is overcome by the head of pressure of the liquid in the wash liquid container when radially outward transfer is to be effected. In order that this feature of the compressing force may be achieved, the centrifuge is operated at different rotational speeds in different steps of the washing procedure, namely, a higher speed when radially inward transfer is to be effected and a lower speed when radially outward transfer is to be effected.

The invention will be described in greater detail below with reference to the accompanying drawings, in which:

DETAILED DESCRIPTION OF THE PREFERRED EMBODIMENTS

Figure 1:
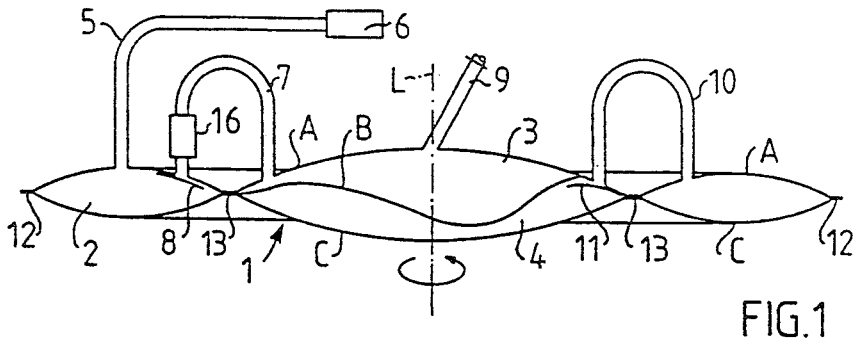
FIG. 1 is a diagrammatic cross-sectional view of a container assembly embodying the invention.
Figure 2:
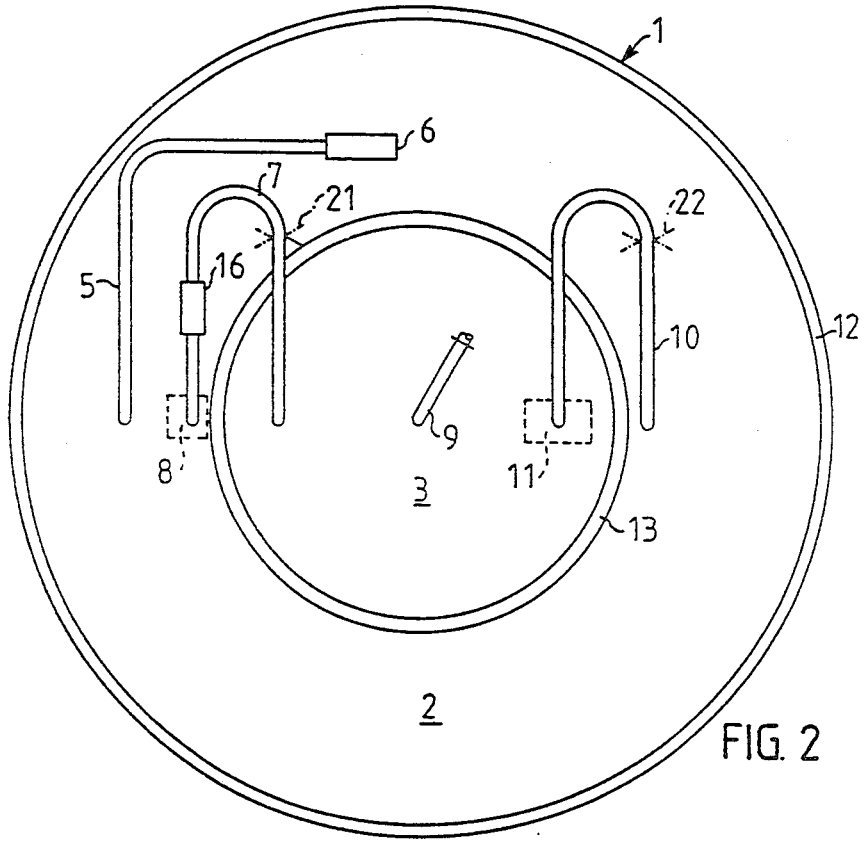
FIG. 2 is a plan view of the container assembly of FIG. 1.

In FIGS. 1 and 2 reference numeral 1 generally designates a container assembly which comprises an annular primary container 2 and two circular secondary containers, a wash liquid container 3 and a waste container 4, positioned one on top of the other in the circular space enclosed by the primary container 1. The three containers are formed of flexible plastic sheet material. A flexible conduit 5 has one end thereof connected with the interior of the primary container 2 and is used for feeding liquid into the primary container and for discharging liquid therefrom. The other end of the conduit 5 is provided with a sterile connector 6.

A collapsible flexible conduit 7 provides a flow path between the interiors of the primary container 2 and the wash liquid container 3. At the location where the conduit 7 is attached to the primary container 2 a one-way valve 8 is provided which comprises a flap of thin flexible sheet material attached to the inner side of the top wall of the primary container 2 so as to overlie the opening of the conduit 7. One end of the flap is free to move relative to the container wall to permit flow of liquid from the wash liquid container into the primary container and prevent flow in the opposite direction.

The wash liquid container 3 is also provided with a flexible conduit 9 which is used for feeding wash liquid into the container. After a predetermined amount of wash liquid has been introduced, the conduit is sealed.

A collapsible flexible conduit 10 provides a flow path between the radially inner portion of the interior of the primary container 2 and the interior of the waste container 4. At the location where the conduit 10 is attached to the waste container a one-way valve 11 similar to the above-mentioned valve 8 is provided on the inner side of the top wall of the container to permit flow of liquid from the primary container into the waste container but prevent flow in the opposite direction.

The container assembly 1 is made of plastic sheets, e.g. of polyvinyl or polyethylene, which are permanently joined by heat sealing. Suitably, the container assembly is formed of three circular concentric sheets A, B and C placed one over the other, the intermediate sheet B having a smaller diameter corresponding to the inner diameter of the annular primary container 2 and the top and bottom sheets A and C having a diameter corresponding to the outer diameter of the primary container. The three sheets are joined by heat sealing at an annular outer seam 12 and an annular inner seam 13 to form the annular primary container 2 and the two circular central containers 3 and 4 which have a common wall formed by the intermediate sheet B.

In order that all of the flexible conduits may be positioned on the top side of the container assembly so as to be readily accessible from above, the top and intermediate sheets A and B are joined by heat sealing also over an area where the conduit 10 and the one-way valve 11 are attached to the waste container 4.

Figure 3:
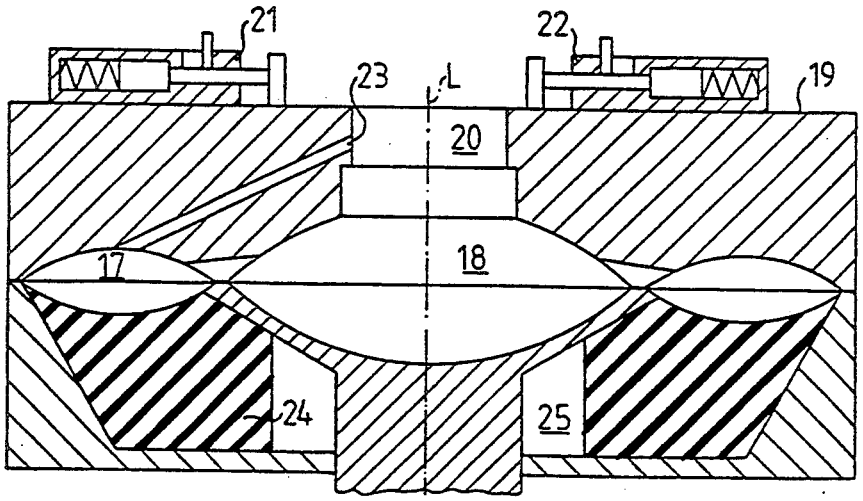
FIG. 3 is a diagrammatic axial view of a centrifuge rotor adapted for use with the container assembly of FIGS. 1 and 2.
Figure 4A:
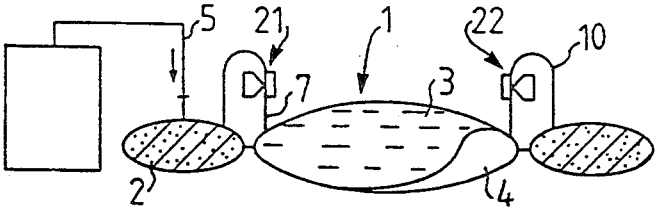
FIGS. 4*a* to 4*j* are diagrammatical cross-sectional views illustrating sequential steps of a washing cycle.
Figure 4B:
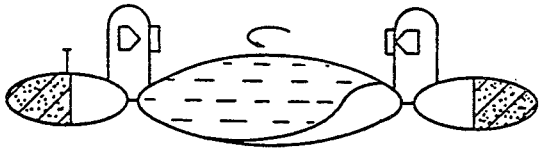
Figure 4C:
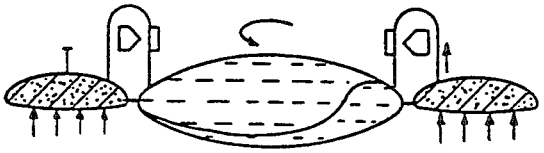
Figure 4D:
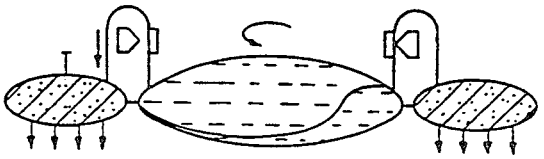
Figure 4E:
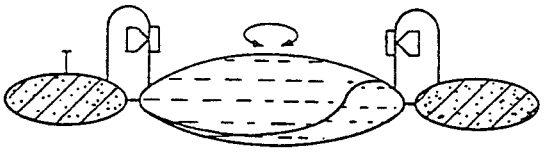
Figure 4F:
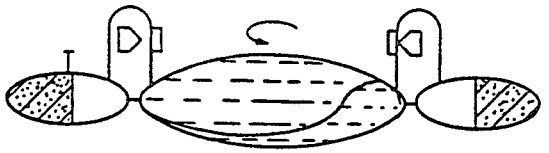
Figure 4G:
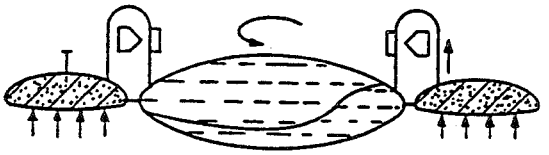
Figure 4H:
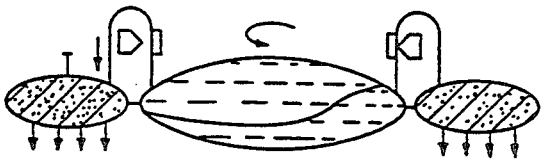
Figure 4I:
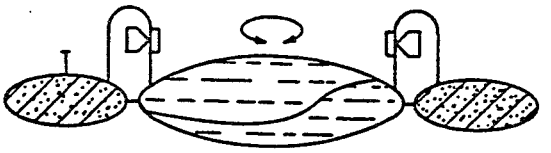
Figure 4J:
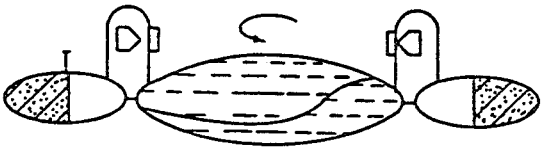

FIG. 3 diagrammatically shows a centrifuge rotor adapted for use with the container assembly 1 of FIGS. 1 and 2 in carrying out blood cell washing in accordance with the invention. A similar centrifuge rotor is described in greater detail in WO 87/06857.

An annular separation compartment extends about the centrifuge head along its periphery. The central compartment communicates with the separation compartment through a slot-like connecting zone. A centrifuge cone is driven by a program controlled motor, and fits in a hub of the centrifuge head. An upper ring is permanently clamped to a bowl-shaped lower portion of the head. An elastic diaphragm is clamped between the bowl and the upper ring. A transparent cover is held onto the centrifuge head by a snap ring.

The centrifuge rotor has an annular outer compartment 17 adapted to receive and enclose the primary container 2 of the container assembly 1 and a circular central compartment 18 adapted to receive the wash liquid and waste containers 3, 4. A central opening 20 is provided in the cover 19 of the rotor.

When the container assembly 1 has been positioned in the rotor compartments 17, 18 and the rotor cover 19 has been positioned over the container assembly, the conduit 5 is pulled up through the cover opening 20 so as to be accessible from above the rotor. The loops formed by the conduits 7 and 10 are also pulled up through the cover opening 20 and positioned in centrifugally actuated pinch valves 21 and 22, respectively, on the rotor cover. To this end, a sealing member (not shown) through which the conduits extend may be pulled upwardly into the cover opening 20 to seal off the rotor compartments. Thereupon the rotor compartments may be placed under overpressure or negative pressure by way of a passage 23.

An annular elastic body 24, e.g. a rubber body, is positioned in the rotor and centered on the rotor axis L. The elastic body 24 forms the bottom wall of the annular outer rotor compartment 17 and is elastically deformable under action of the centrifugal field to reduce the volume of this rotor compartment and thereby to compress the collapsible primary container received therein. The deformation and resulting compressing action of the elastic body may be amplified or modified by means of radially movable weight segments 25 arranged in a ring about the inner periphery of the elastic body.

A programmed-controlled motor (not shown) rotates the centrifuge rotor at selected speeds.

When a batch of red blood cells is to be washed, e.g. following thawing and in preparation for use of the blood cells for transfusion, the container assembly 1 is positioned in the rotor compartments as explained above. A predetermined volume of wash liquid, e.g. a solution containing 0.9 percent of NaCl and 0.2 percent of glucose, has previously been introduced in the wash liquid container 3 and the conduit 9 has then been sealed by means of a heat sealing tool.

Moreover, the conduit 7 has been provided with a closure device, e.g. a pinch clamp, which can readily be removed when desired, or an internal flow barrier, such as shown at 16, which can be broken by bending the conduit. The connector 6 of the conduit 5 is made accessible from above the rotor and the conduits 7 and 10 are inserted in the normally closed pinch clamps 21 and 22, respectively. Thereupon, the closure device of the conduit 7 is removed or the flow barrier 16 is broken.

FIGS. 4*a* to 4*j* diagrammatically illustrate the processing sequence following the insertion of the container assembly 1 in the centrifuge rotor.

As an initial step (FIG. 4*a*) a batch of red blood cells, e.g. red blood cells which have previously been glycerolized and stored in frozen state and then thawed in preparation for reuse, is fed into the primary container 2 through the conduit 5. In this step the centrifugally actuated valves 21 and 22 are held in closed condition. Thereupon, the conduit 5 is sealed.

In a second step (FIG. 4*b*) the centrifuge rotor is spun at a predetermined first speed sufficient to cause the valve 21 to open but insufficient for the valve 22 to open. Although the valve 21 is opened, the conduit 7 is still blocked to flow from the primary container 2 because the one-way valve 8 is closed. As a result of the rotor spinning, the red blood cells are sedimented in the circumferential outer portion of the primary container 2 and a supernatant fraction (glycerol and other substances having a density less than that of the red blood cells) is formed in the circumferential inner portion.

The third step (FIG. 4*c*) comprises accelerating the rotor to a predetermined second, higher speed sufficient to cause the centrifugally actuated valve 22 to open. This speed is also sufficient to cause the elastic body 24 to deform under action of the centrifugal field and exert a pressure on the primary container 2 and thereby compress it so that the supernatant fraction is expressed radially inwardly through the conduit 10 into the waste container 4.

In the fourth step (FIG. 4*d*) the rotor is decelerated sufficiently to cause the valve 22 to close. The speed at which the valve 22 closes is sufficiently low to allow the elastic body 24 to retract so that the primary container 22 can expand, but still sufficiently high to keep the valve 21 open. As a consequence, wash liquid will pass through the conduit 7 into the primary container 2 until this container has expanded to the limit set by the walls of the outer rotor compartment 17.

In the fifth step (FIG. 4*e*) the centrifuge rotor is braked rapidly so that the valve 21 is also closed and the cells become suspended in the wash liquid that has been transferred into the primary container 2. Following the rapid deceleration caused by the braking, the rotor is oscillated about the axis of rotation L to bring about an intensive agitation of the cells in the wash liquid.

In the sixth step (FIG. 4*f*), the rotor is again accelerated to the first speed so that the cells are again sedimented in the circumferential outer portion while a supernatant fraction consisting mainly of wash liquid and liberated contaminants is formed in the circumferential inner portion. This step is more or less identical with the second step.

Then the third and following steps are repeated (FIGS. 4*g* to 4*j*) as many times, normally 3 or 4 times, as are required to make the cells clinically acceptable, e.g. for transfusion to a patient.

The last quantity of wash liquid transferred into the primary container is left therein to serve as a suspending or carrier liquid for the blood cells, and finally the contents of the primary container are transferred to a standard transfusion bag through the conduit 5.

As is readily appreciated, the flow pattern and container configuration according to the invention makes it possible to utilize substantially the full diameter of the centrifuge rotor for the separation, because there is no need for a container positioned radially outwardly of the container holding the cells. Moreover there is no need for solid transverse walls separating adjacent containers in the centrifuge rotor; such walls would hamper the loading of the container assembly into the centrifuge rotor and the removal of the container assembly from the rotor.

Figure 5:
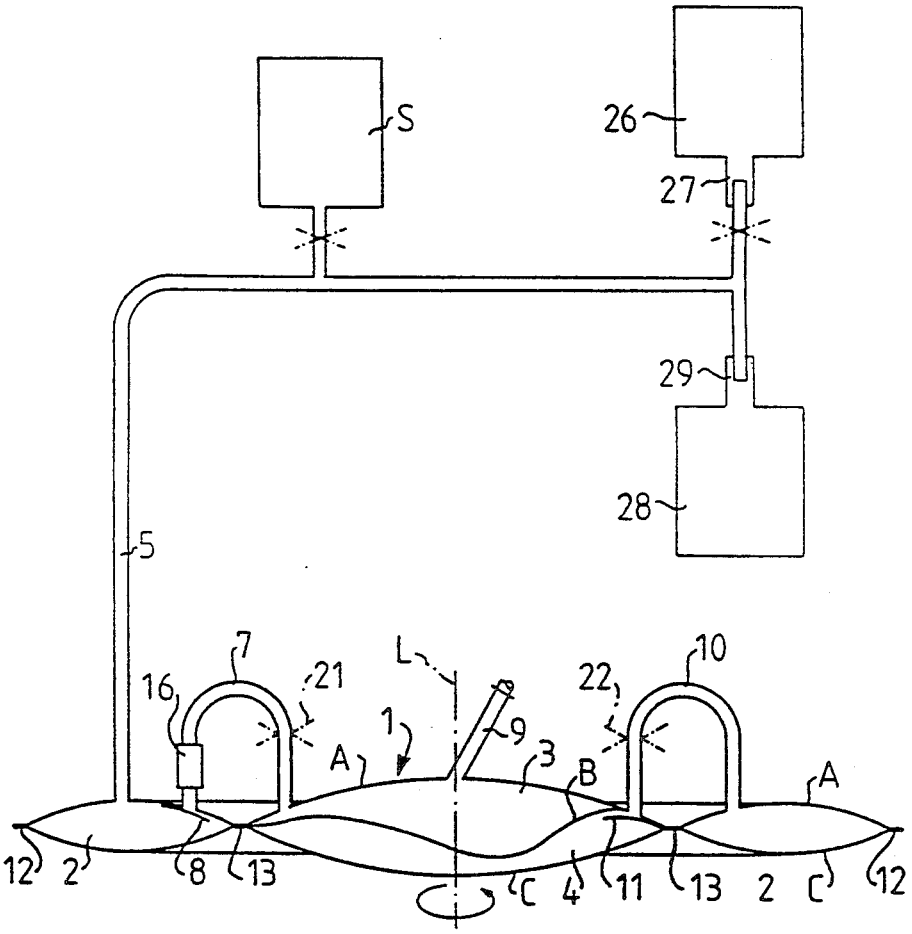
FIG. 5 and FIG. 6 are diagrammatic views similar to FIG. 1 of modified embodiments of the container assembly.

FIG. 5 shows a container assembly 1 which is generally similar to that shown in FIGS. 1 and 2 except in that it comprises additional bag-like containers connected with the conduit 5. This modified container asembly is suitable for use in the washing of blood that has been treated according to the high-glycerol technique and accordingly contains about 40 percent by weight of glycerol. In FIG. 5 reference numerals 1 to 16 designate elements already described with reference to FIGS. 1 and 2.

Connected to the conduit 5 are an additional wash liquid container 26 provided with a rupturable closure 27, an empty transfusion container 28 which has a rupturable closure 29 and a connector for a container S holding stored glycerolized red blood cells. The container 26 holds hypertonic (12 percent) saline.

Except as described below, the container assembly 1 of FIG. 5 is used substantially in the same manner as the container assembly shown in FIGS. 1 and 2.

After the blood cell container S has been connected to the conduit 5 and the blood cells have been transferred with the glycerol into the primary container 2, the connection is closed by means of a heat sealing tool. The glycerolized blood cells are centrifuged with the containers 26 and 28 positioned on top of the wash liquid container 3 in the central rotor compartment 18, and the glycerol supernatant is transferred into the waste container 4. Thereupon the centrifuge is stopped, the closure 27 is broken, and wash liquid held in the additional wash liquid container 26 is transferred into the primary container. This transfer may be effected e.g. under action of negative pressure in the centrifuge rotor. When the container 26 is emptied its connection with the conduit 5 is cut and heat sealed. At the same time the temporary closure device 16 of the conduit 7 is opened.

The blood cells suspended in the hypertonic wash liquid are then centrifuged and washed in the manner described above with reference to FIG. 4 using the wash liquid held in the wash liquid container 3. When the washing procedure is completed, the blood cells are suspended in the last quantity of wash liquid and transferred into the transfusion container 28 after its closure 29 has been ruptured. It is also possible to replace the transfusion container 28 with a transfusion kit as shown in FIG. 6.

Figure 6:
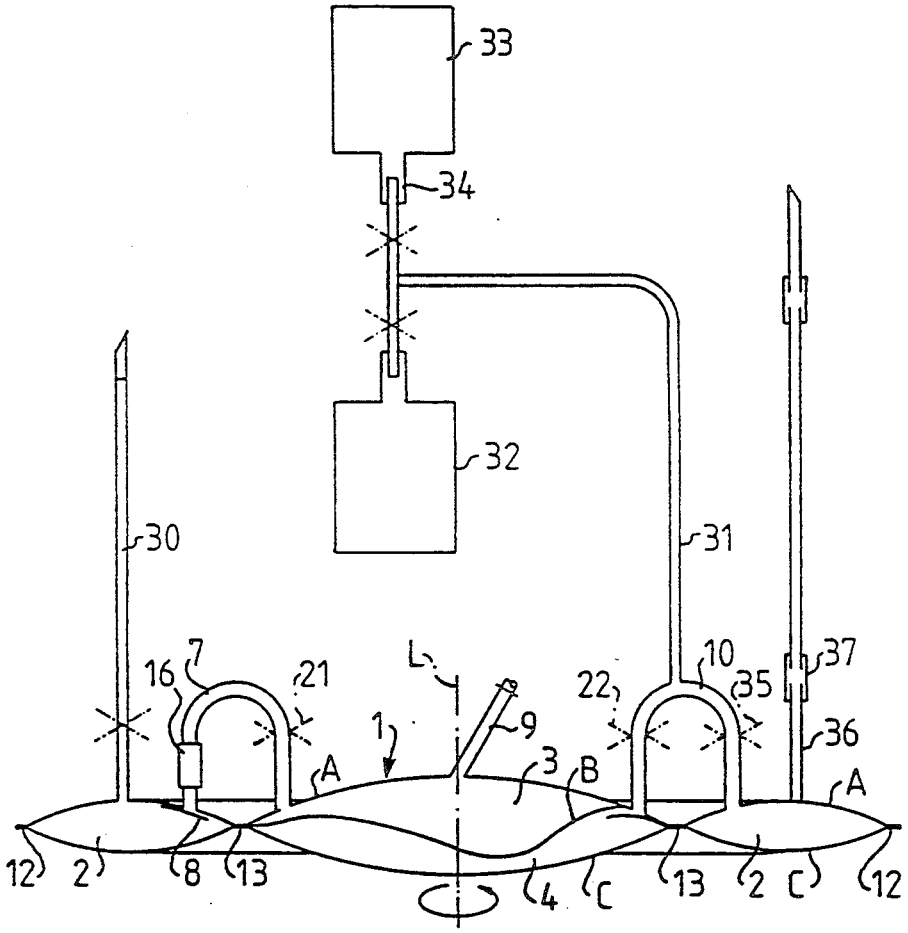

FIG. 6 shows a blood processing kit which can conveniently be used to (1) separate whole blood into cells and plasma, (2) treat the cells with a liquid preservative, and (3) wash the thus preserved cells when they are to be reused.

In FIG. 6 reference numerals 1 to 16 designate elements which have already been described with reference to FIGS. 1 and 2.

Connected to the primary container 2 is a supply conduit 30 through which whole blood may be fed from a blood donor into the primary container. A branch conduit 31 is connected at one end to the conduit 10 and at the other end to an initially empty plasma container 32 and to a container 33 holding a liquid preservative for blood cells, e.g. according to Meryman et al, Transfusion, Nov.-Dec. 1986, Vol. 26, pp. 500-505.

A rupturable closure 34 of the conduit 31 may be opened manually by bending the conduit.

A discharge conduit 36 connected to the primary container 2 includes a sterile coupling 37 for connection to a transfusion kit or it may be connected to such a kit in the production process. In the latter case the sterile coupling 37 is replaced with a rupturable closure. Alternatively, a transfusion container may be connected.

In use of the processing kit of FIG. 6, the kit is positioned in the centrifuge rotor with the containers 32 and 33 placed in the central rotor compartment 18 on top of the wash liquid container 3. The conduit 30 is made accessible from above the rotor through the rotor cover opening 20 and loops formed by the conduits 7 and 10 are inserted in the pinch valves 21 and 22, respectively.

Whole blood is withdrawn from a blood donor and fed through the conduit 30 into the primary container 2 which has previously been charged with a suitable amount of anticoagulant, such as CPD (citrate-phosphate-dextrose) solution. The conduit 30 is then cut and sealed.

The rotor is spun at a first speed such that blood cells and plasma are separated before the rotor is accelerated to a second speed to cause the centrifugally actuated valve 22 to open and to cause the elastic body 24 to express the plasma through the conduits 10, 31 into the plasma container 32.

Then the plasma container 32 is cut free by means of a heat sealing tool, the conduit 10 is removed from the valve 22, the closure 35 is opened, and the liquid preservative is transferred to the blood cells in the primary container 2. This transfer may be assisted by a negative pressure within the rotor and the rotor may be oscillated about its axis of rotation to agitate the cells in the liquid preservative. Thereupon, the conduit 31 is cut and the preserved blood is ready for storage.

While the above-described steps are carried out, the conduits 7 and 10 are blocked by the temporary closures 16 and 35.

When the preserved blood is to be reused, the processing kit, now comprising only the containers 2, 3, 4, is again positioned in the rotor, the closures 16 and 35 are opened, and washing is carried out as described with reference to FIG. 4.

I claim:

1. A method of washing blood cells in a system of closed collapsible containers of flexible material which are positioned concentrically in a centrifuge rotor, the blood cells being held in an annular primary container into which wash liquid is transferred under action of the centrifugal field through a valve-controlled first passage from a wash liquid container positioned centrally in the centrifuge rotor and from which a centrifugally formed supernatent is transferred through a valve-controlled second passage into a waste container while the primary container is being compressed under action of the centrifugal field, said method comprising the following steps:

transferring the supernatent into a waste container positioned centrally of the centrifuge rotor;

deforming an elastic body positioned in the centrifuge rotor to compress the primary container; and transferring wash liquid into the primary container after lowering the rotational speed of the centrifugal rotor to a speed below the speed at which the supernatent is transferred.

2. A method according to claim 1, further comprising the following steps:

carrying out centrifugation at a first rotational speed of the centrifuge rotor while the second passage is closed; and increasing rotational speed of the rotor to deform said elastic body.

3. A method according to claim 1, further comprising the step of agitating the contents of the primary container by changing the rotor speed following the transfer of wash liquid from the wash liquid container.

4. A container assembly for use in washing of blood cells in a centrifuge, said container assembly comprising the following:

an annular closed collapsible primary container of flexible material;

a circular closed collapsible wash liquid container of flexible material positioned radially inwardly of said primary container;

a collapsible first connecting conduit between said primary container and said wash liquid container;

a closed collapsible waste container of flexible material;

a collapsible second connecting conduit disposed between said primary container and said waste container;

conduit means for feeding blood into said primary container and for feeding wash liquid into said wash liquid container; and wherein said primary container, said wash liquid container, and said waste container are formed of flexible sheets which are positioned one over the other and permanently joined through an annular outer seal and an annular inner seal;

whereby blood and wash liquid may be transferred between said collapsible containers under the influence of centrifugal force.

5. A container assembly according to claim 4, wherein said wash liquid container and said waste container have a common wall.

6. A container assembly according to claim 4, wherein said inner seal is common to said primary container, said wash liquid container, and said waste container.

7. A container assembly according to claim 4, wherein said first connecting conduit is provided with a one way valve permitting flow only from said wash liquid container into said primary container, and further wherein said second connecting conduit has a one way valve permitting flow only from said primary container into said waste container.

8. A container assembly according to claim 7, wherein said one way valve associated with said first connecting conduit comprises a sheet-material flap attached to an inner side wall of said primary container and overlies an end of said first connecting conduit opening into said primary container, and further wherein said one way valve associated with said second connecting conduit comprises a sheet-material flap attached to an inner side wall of said waste container and overlies an end of said second connecting conduit opening into said waste container.

* * * * *